US009144285B2

(12) United States Patent
Chudzik

(10) Patent No.: US 9,144,285 B2
(45) Date of Patent: Sep. 29, 2015

(54) HAIR ACCESSORIES AND METHODS FOR THEIR MANUFACTURE

(71) Applicant: Stan Chudzik, Alpharetta, GA (US)

(72) Inventor: Stan Chudzik, Alpharetta, GA (US)

(73) Assignee: GOODY PRODUCTS, INC., Atlanta, GA (US)

( * ) Notice: Subject to any disclaimer, the term of this patent is extended or adjusted under 35 U.S.C. 154(b) by 0 days.

(21) Appl. No.: 13/975,829

(22) Filed: Aug. 26, 2013

(65) Prior Publication Data

US 2014/0053863 A1 Feb. 27, 2014

Related U.S. Application Data

(60) Provisional application No. 61/693,532, filed on Aug. 27, 2012.

(51) Int. Cl.

| | |
|---|---|
| ***A45D 24/00*** | (2006.01) |
| ***A45D 7/00*** | (2006.01) |
| ***A45D 8/00*** | (2006.01) |
| ***B05D 1/16*** | (2006.01) |
| ***B05D 1/14*** | (2006.01) |
| ***B05D 5/00*** | (2006.01) |
| ***B05D 1/00*** | (2006.01) |
| ***B05D 1/02*** | (2006.01) |
| *A45D 8/20* | (2006.01) |
| *A45D 8/24* | (2006.01) |

(52) U.S. Cl.

CPC *A45D 8/00* (2013.01); *B05D 1/025* (2013.01); *B05D 1/14* (2013.01); *A45D 8/20* (2013.01); *A45D 8/24* (2013.01); *Y10T 156/10* (2015.01)

(58) Field of Classification Search

CPC ..... A45D 8/00; A45D 8/20; A45D 8/24; A05D 1/14; B05D 1/16; B05D 1/06; B05D 1/14; B05D 1/025; B05D 1/04; B05D 1/007; D04H 11/00; Y10T 156/10

USPC ..... 132/273, 200, 212, 219, 144, 162, 163, 132/222, 223, 224, 274–284; 428/90–92; 427/206, 462–465, 200; 2/171, 174, 2/207, 209.4, DIG. 11; 156/1

See application file for complete search history.

(56) References Cited

U.S. PATENT DOCUMENTS

| | | | | |
|---|---|---|---|---|
| 1,908,970 | A | 5/1933 | Frankel | |
| 3,566,886 | A * | 3/1971 | Solomon | 132/262 |
| 3,672,362 | A * | 6/1972 | Basche | 606/204.35 |
| 3,724,421 | A * | 4/1973 | Schneck et al. | 118/630 |
| 3,772,132 | A | 11/1973 | Dulin, Jr. | |
| 3,832,841 | A * | 9/1974 | Cole | 57/207 |
| 3,856,026 | A * | 12/1974 | Gaydos | 132/73 |
| 3,888,266 | A * | 6/1975 | Weldon et al. | 132/221 |
| 3,917,883 | A | 11/1975 | Jepson | |
| 3,935,370 | A | 1/1976 | Marti | |
| 4,103,693 | A * | 8/1978 | Reagan | 132/276 |
| 4,150,678 | A * | 4/1979 | Photopulos | 132/53 |
| 4,567,904 | A * | 2/1986 | Pitcher et al. | 132/266 |
| 4,579,132 | A * | 4/1986 | Thaler | 132/226 |
| 4,581,519 | A * | 4/1986 | Thaler et al. | 219/225 |
| 4,598,722 | A * | 7/1986 | Doyle | 132/226 |
| 4,692,366 | A | 9/1987 | Mudge | |
| 4,696,951 | A | 9/1987 | Lunsford et al. | |
| 4,834,118 | A * | 5/1989 | Goeller | 132/211 |
| 5,799,672 | A * | 9/1998 | Hansbury | 132/273 |
| 6,092,534 | A * | 7/2000 | Cheung | 132/226 |
| 6,173,718 | B1 * | 1/2001 | Okumoto et al. | 132/224 |
| 6,334,450 | B1 * | 1/2002 | Collis | 132/210 |
| 6,516,853 | B1 * | 2/2003 | Gabrielson et al. | 156/443 |
| 6,622,735 | B2 * | 9/2003 | Hirata et al. | 132/224 |
| 6,945,255 | B2 * | 9/2005 | Kampel et al. | 132/226 |
| 7,059,333 | B2 * | 6/2006 | Duqueroie | 132/114 |
| 7,305,996 | B2 * | 12/2007 | Kraft et al. | 132/273 |
| 7,610,921 | B2 * | 11/2009 | Gold | 132/53 |
| 7,735,496 | B2 | 6/2010 | Ellegard | |
| 7,749,589 | B2 | 7/2010 | Abrams | |
| 7,798,155 | B2 * | 9/2010 | Schweers et al. | 132/273 |
| 7,833,453 | B2 | 11/2010 | Lion et al. | |
| 7,854,196 | B2 | 12/2010 | Walz | |
| 7,897,236 | B2 | 3/2011 | Merovitz | |
| 8,007,889 | B2 | 8/2011 | Abrams | |
| 8,017,233 | B2 | 9/2011 | Miyazono et al. | |
| 8,101,260 | B2 | 1/2012 | Tatsumi | |
| 8,128,457 | B2 | 3/2012 | Reinisch et al. | |
| 2006/0037625 | A1 * | 2/2006 | Kayser et al. | 132/224 |
| 2006/0085891 | A1 * | 4/2006 | Larkin et al. | 2/171 |
| 2006/0162046 | A1 * | 7/2006 | Chudzik et al. | 2/174 |
| 2008/0060669 | A1 * | 3/2008 | Malvar et al. | 132/218 |
| 2008/0308119 | A1 * | 12/2008 | Smith | 132/202 |
| 2009/0306599 | A1 * | 12/2009 | Furuzono et al. | 604/175 |
| 2010/0012140 | A1 | 1/2010 | Fitzpatrick | |
| 2010/0175704 | A1 * | 7/2010 | Gueret | 132/200 |
| 2010/0209654 | A1 * | 8/2010 | Abrams | 428/90 |
| 2011/0240340 | A1 * | 10/2011 | Takanaga et al. | 174/133 R |
| 2014/0048094 | A1 * | 2/2014 | Carriedo | 132/210 |
| 2014/0096789 | A1 * | 4/2014 | Caruso | 132/280 |
| 2014/0113095 | A1 * | 4/2014 | Xu | 428/37 |
| 2015/0090288 | A1 * | 4/2015 | Chudzik | 132/273 |

FOREIGN PATENT DOCUMENTS

| | | |
|---|---|---|
| EP | EP0556026 | 8/1993 |

* cited by examiner

*Primary Examiner* — Vanitha Elgart

(74) *Attorney, Agent, or Firm* — Sutherland Asbill & Brennan LLP

(57) ABSTRACT

Hair accessories include (a) a substrate having a hair-holding surface configured for holding hair, and a structural surface; and (b) a layer provided on at least a portion of the hair-holding surface, wherein the layer contains a plurality of flocked fibers. Methods of manufacturing hair accessories are described.

11 Claims, 9 Drawing Sheets

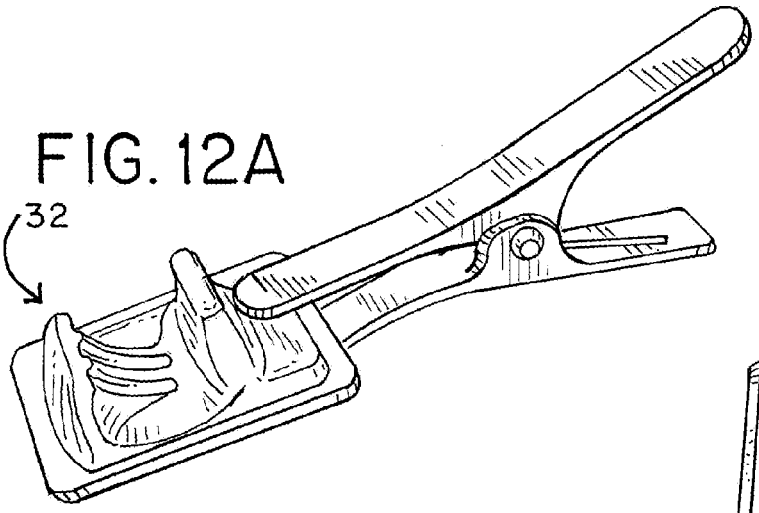
FIG. 12A
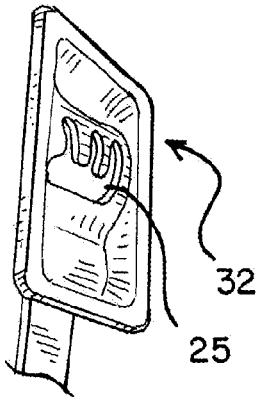
FIG. 12B
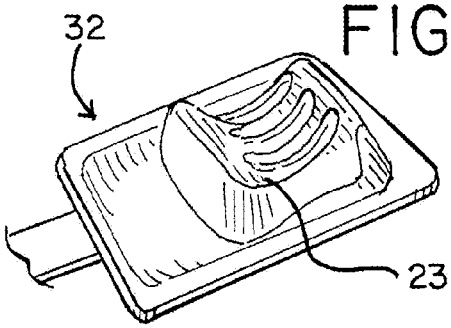
FIG. 12C
FIG. 13A
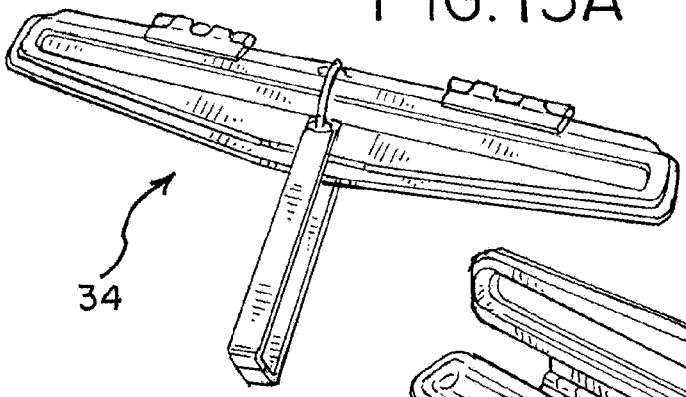
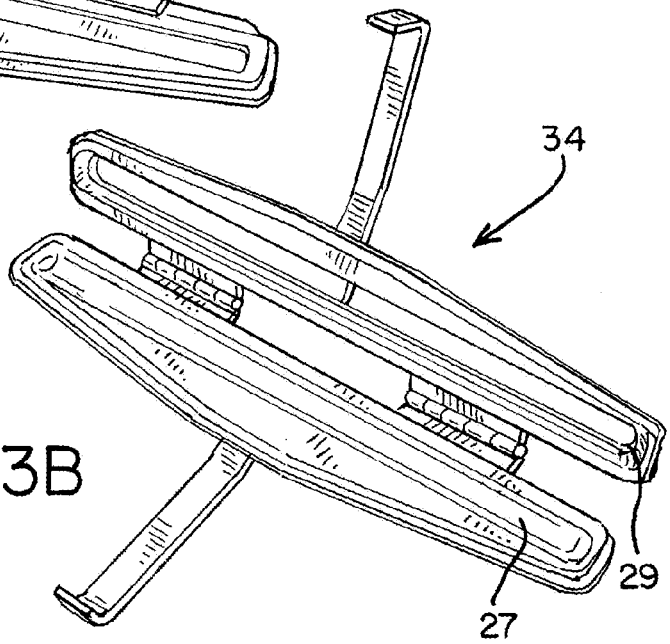
FIG. 13B

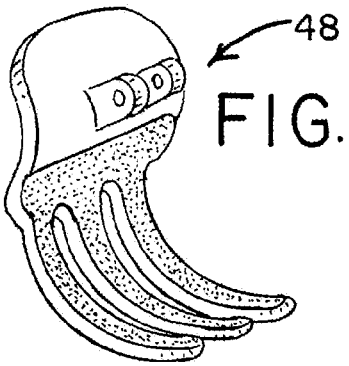
FIG. 16
FIG. 17
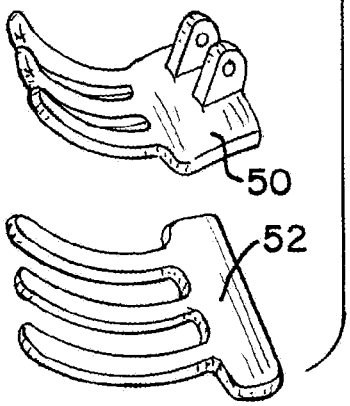
FIG. 18A
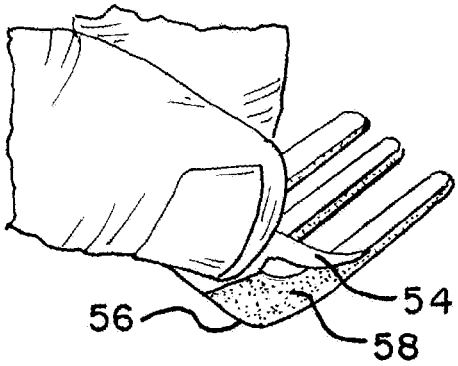
FIG. 18B
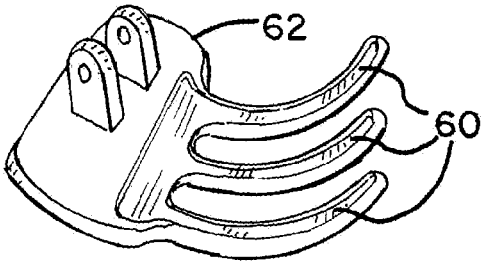
FIG. 19
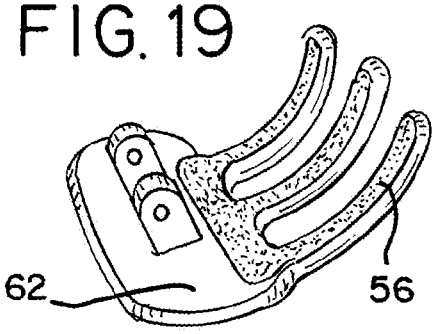
FIG. 20A
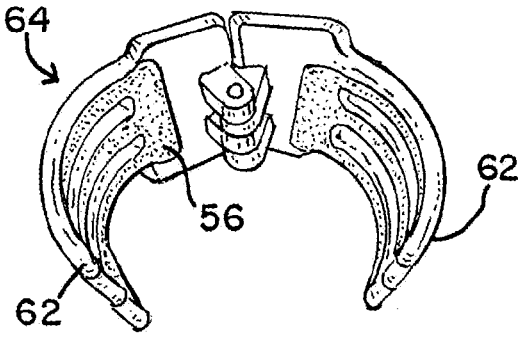
FIG. 20B
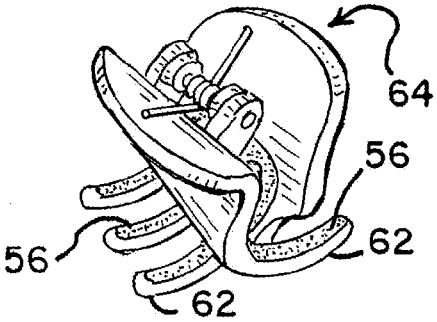

HAIR ACCESSORIES AND METHODS FOR THEIR MANUFACTURE

RELATED APPLICATIONS

This application claims the priority benefit of U.S. Provisional Application No. 61/693,532, filed Aug. 27, 2012. The entire contents of the provisional application are incorporated herein by reference, except that in the event of any inconsistent disclosure or definition from the present specification, the disclosure or definition herein shall be deemed to prevail.

TECHNICAL FIELD

The present teachings relate generally to hair accessories and methods for their manufacture.

BACKGROUND

Various hair accessories have been employed for the purpose of holding hair in a desired arrangement or hairstyle. A common problem with many hair accessories is a tendency to slip out of place over time and, consequently, to fail to preserve a desired arrangement of hair. The problem of slippage is exacerbated during periods of increased physical activity when an individual's increased range of body motion and/or head movement may cause the hair accessory to slide on the hair, thereby deteriorating a desired hairstyle. By way of example, a claw clip worn around a ponytail during certain physical activities has a tendency to slip and lose its hold on hair. Slippage is a source of frustration to users of hair accessories since the need to readjust and/or reinstall a hair accessory in order to secure a stronger hold on the hair and/or to repair a desired hairstyle interrupts the user's intended activity. Moreover, for many users, the response to the frustration of repeated slippage is simply to remove the hair accessory completely and abandon further efforts to preserve what was previously a desired hairstyle.

A second problem with many hair accessories is their tendency to damage hair—particularly though not exclusively during removal. The hair accessory may potentially pull or snag hair each time it is manipulated, so repetitive installations and/or adjustments of the hair accessory in response to undesirable slippage increase the likelihood of damaging an individual's hair.

A third problem with many hair accessories is their tendency to create a hair "dent" in areas from which they are removed (e.g., the crown of the head, a ponytail, etc.). These residual hair dents are oftentimes noticeable long after the hair accessory has been removed, which presents the user with two undesirable options: endure the frustration of repeated installation and/or adjustment of the hair accessory or remove the hair accessory altogether and risk an unsightly hair dent.

In response to one or more of the above-described problems, various hair accessories have been previously proposed, which are purported to have an increased ability to hold hair and a reduced tendency towards slippage. However, such products tend to grip hair too aggressively, which increases the likelihood of pulling out and/or damaging hair upon removal of the hair accessory.

SUMMARY

The scope of the present invention is defined solely by the appended claims, and is not affected to any degree by the statements within this summary.

By way of introduction, a first hair accessory in accordance with the present teachings includes (a) a substrate having a hair-holding surface configured for holding hair, and a structural surface; and (b) a layer provided on at least a portion of the hair-holding surface, wherein the layer contains a plurality of flocked fibers.

A second hair accessory in accordance with the present teachings includes (a) a substrate having a hair-holding surface configured for holding hair, and a structural surface; and (b) a layer provided on at least a portion of the hair-holding surface. The layer contains a plurality of flocked fibers secured to the hair-holding surface via an adhesive. At least a portion of the plurality of flocked fibers is oriented substantially perpendicular to the hair-holding surface. The structural surface is substantially devoid of flocked fibers.

A method of manufacturing a hair accessory in accordance with the present teachings includes: (a) providing a substrate having a hair-holding surface configured for holding hair, and a structural surface; and (b) applying a layer to at least a portion of the hair-holding surface, wherein the layer comprises a plurality of flocked fibers.

BRIEF DESCRIPTION OF THE DRAWINGS

FIG. 12A shows a perspective view of a representative first masking fixture.

FIG. 12B shows a first detail of the masking fixture of FIG. 12A.

FIG. 12C shows a second detail of the masking fixture of FIG. 12A.

FIG. 13A shows a perspective view of a representative second masking fixture, which is shown in a closed position.

FIG. 13B shows a perspective view of the masking fixture of FIG. 13A, which is shown in an open position.

FIG. 16 shows a perspective view of a representative flocked sub-component of a hair accessory in accordance with the present teachings.

FIG. 17 shows a perspective view of two unassembled sub-components of a claw clip hair accessory of which only an inner claw clip half is to receive a flocking layer.

FIG. 18A shows removal of a backing paper from a die-cut flocking layer insert to expose its adhesive layer.

FIG. 18B shows a recess in an interior side of a claw clip half, which is configured to receive the die-cut flocking layer insert of FIG. 18A.

FIG. 19 shows the claw clip half of FIG. 18B after installation of the die-cut flocking layer insert into the recess.

FIG. 20A shows a claw clip in accordance with the present teachings, which is assembled from two of the claw clip halves of FIG. 19 and which is shown in an open position.

FIG. 20B shows the claw clip of FIG. 20A in a closed position.

DETAILED DESCRIPTION

Hair accessories having hair-gripping surfaces flocked with fibers, and methods for their manufacture, have been discovered and are described herein. The hair accessories described herein have enhanced hair-gripping and/or hair-holding capabilities as compared to conventional designs and, in some embodiments, alleviate oft-cited consumer frustrations related to inadequate holding strength and/or damaging effects on hair of conventional hair accessories.

As further described below, hair accessories in accordance with the present teachings may include a layer having a plurality of flocked fibers. As used herein, the phrase "flocked fibers" and similar expressions refer to a fabric and/or textile material having a fibrous surface that, in some embodiments, conveys a soft tactile feel akin to that of velvet, velour, suede and/or the like. In some embodiments, a "layer having a plurality of flocked fibers" corresponds to velvet, a velvet-like material, velour, a velour-like material, suede, a suede-like material, and/or the like. It has been discovered that a flocked fiber component may be used to provide a gentle hold on hair without causing the kind of damage to hair that is commonly observed with conventional hair accessories and their overly aggressive grips. The flocked fiber material includes a plurality of small fibers that are cut or applied in a manner to produce a soft gentle fabric and/or textile surface on a hair accessory. The softness of the fabric and/or textile fibers precludes an overly aggressive hold on hair that could otherwise lead to hair being damaged during installation, wearing, and/or removal of the hair accessory, and also provides a design signal to a user that the product will be gentle on the user's hair.

In some embodiments in accordance with the present teachings, one or more interior surfaces of a hair accessory (e.g., surfaces configured to contact and/or to hold hair) are lined with a flocked fiber fabric and/or textile. Previously, such coatings have not been provided on any of the internal hair-holding surfaces (which typically cannot be seen when the hair accessory is in use). Indeed, heretofore, there has been no recognition whatsoever of there being any functional (as opposed to merely aesthetic) benefit to lining an interior surface of a hair accessory with a flocked fiber material.

Figure 22:
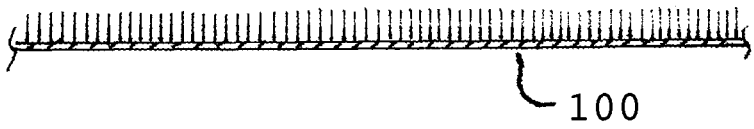
FIG. 22 shows a cross-sectional view of a flocked substrate.
Figure 23:
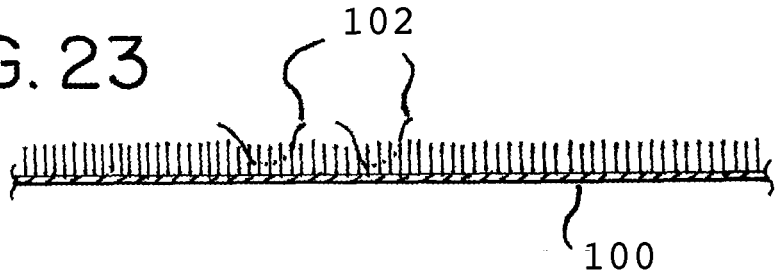
FIG. 23 shows a cross-sectional view of the flocked substrate of FIG. 22 in use in hair.

In a flocked fiber layer in accordance with the present teachings, the fibers protruding from the surface of the substrate—which, in some embodiments, protrude substantially perpendicularly—provide increased surface area for the hair to intertwine with the fibers in the voids therebetween, thus establishing a mechanical mode of attachment. As used herein, the phrase "substantially perpendicular" is intended to mean that the fibers extend from the hair-holding surface at a relative angle of greater than 45 degrees (or, in other words, the fibers are more perpendicular to the hair-holding surface than parallel). FIG. 22 shows a cross-sectional view of a flocked substrate 100 in which the flocked fibers have a "substantially parallel" orientation and voids therebetween. FIG. 23 shows a cross-sectional view of the flocked substrate 100 of FIG. 22 with hair 102 engaged with and intertwined between the flocked fibers in the voids.

It is to be understood that elements and features of the various representative embodiments described below may be combined in different ways to produce new embodiments that likewise fall within the scope of the present teachings.

By way of general introduction, a hair accessory in accordance with the present teachings includes (a) a substrate having a hair-holding surface configured for holding hair, and a structural surface; and (b) a layer provided on at least a portion of the hair-holding surface, wherein the layer includes a plurality of flocked fibers.

All manner of hair accessories are contemplated in accordance with the present teachings. Representative hair accessories include but are not limited to hard headbands, soft head wraps (e.g., PVC/"jelly"), claw clips, contour clips (a.k.a. snap clips), self-hinge barrettes, auto clasps, hair picks, and the like, and combinations thereof.

As used herein, the phrase "hair-holding surface" refers to any surface of a hair accessory that is configured to contact and to actively participate in the holding of hair. While the principal function of a hair-holding surface may be to hold hair in place, it is to be understood that the term "hold" does not imply immobilization of hair against all conceivable forces tending to move or dislodge hair from the hair accessory and/or cause the hair accessory to loosen its grip on the hair.

As used herein, the phrase "structural surface" refers to any surface of a hair accessory that may or may not come into direct contact with hair during use, and which is not intrinsically intended and/or configured to actively participate in the holding of hair. While the function per se of a structural surface may not be to hold hair, it is to be understood that, in some embodiments and/or in some applications, a structural surface may periodically assist with the function of holding hair or at least come in contact with hair during use. In some embodiments, the structural surface is substantially devoid of flocked fibers. In some embodiments, the structural surface is directed away from an individual's head when the hair accessory is placed in the individual's hair. In some embodiments, the structural surface is observable by others when the hair accessory is placed in an individual's hair. In some embodiments, the structural surface is ornamental.

In the description that follows, the phrases "interior surface" (e.g., a surface directed inward or towards a user's hair) and "exterior surface" (e.g., a surface directed away from a user's hair or towards an observer) may sometimes be used to describe a hair accessory and are to be understood in the formal sense as referring, respectively, to a "hair-holding surface" and a "structural surface" as defined above. The phrases "interior surface" and "exterior surface" are used purely for convenience and are not intended in any absolute or limiting physical sense (e.g., with respect to the cardinal directions, or as an implication of there being open or closed three-dimensional geometries, etc.).

The substrate having the hair-holding surface and the structural surface may be formed from all manner of materials. Representative materials for the substrate include but are not limited to wood, metal, metal alloys, plastic, glass, and the like, and combinations thereof. The type of plastic from which a substrate may be formed is not restricted. Representative plastic resins include but are not limited to acrylonitrile butadiene styrene (ABS); polystyrene (PS); styrene acrylonitrile (SAN); polypropylene (PP); poly(methyl methacrylate) (PMMA a.k.a. "acrylic"); high impact polystyrene (HIPS); styrene-butadiene copolymers (SBC), including but not limited to that sold under the tradename K-RESIN by Chevron Phillips Chemical Company LLC (The Woodlands, Tex.); polycarbonate; poly(styrene-b-methyl methacrylate), including but not limited to that sold under the tradename KOSTRATE by Plastic Selection Group, Inc. (Columbus, Ohio); thermoplastic elastomers (TPE); polyvinyl chloride (PVC); polyvinyl alcohol (PVA); polyurethanes (PU); silicone (SI); natural latex rubber; nylons; and the like; and combinations thereof.

In some embodiments, a substrate for use in accordance with the present teachings is monolithic (e.g., formed of a single part and/or cast as a single piece). A representative and non-limiting example of a hair accessory based on a monolithic substrate includes but is not limited to a hard headband. In some embodiments, the substrate includes a plurality of sub-components that are configured for detachable assembly to form the hair accessory. A representative and non-limiting example of a hair accessory based on an assembly of sub-components includes but is not limited to a claw clip.

In some embodiments, the plurality of flocked fibers forms a fabric and/or a textile. As used herein, the terms "fabric" and "textile" are applied more or less interchangeably. However, in specialized usage, the term "textile" is typically used to refer to any material made of interlacing fibers. Similarly, in specialized usage, the term "fabric" is typically used to refer to any material made through weaving, knitting, spreading, crocheting, knotting, pressing fibers together, bonding, or the like. As used herein, all manner of such materials are intended to be included in any references to fabric and/or textile materials. Representative fabrics and/or textiles in accordance with the present teachings include but are not limited to velvet, velvet-like materials, suede, suede-like materials, velour, velour-like materials, and the like, and combinations thereof. All manner of fibrous materials are contemplated for use in accordance with the present teachings. Representative materials include but are not limited to silk; cotton; aliphatic polyamides, such as nylons (e.g., nylon-6,6; nylon-6; nylon-6,9; nylon-6,12; nylon-11; nylon-12; nylon-4,6; and the like; and combinations thereof); cellulose acetate (a.k.a. acetate); polyacrylonitrile (a.k.a. acrylic); rayon (e.g., viscose, modal, lyocell, and the like, and combinations thereof); polyester, including but not limited to polyethylene terephthalate (PET), and the like; linen; wool; and the like; and combinations thereof.

The length of the individual flocked fibers used in accordance with the present teachings is not restricted. In some embodiments, each of the plurality of flocked fibers comprises a length of between about 0.30 mm and about 5.0 mm, in some embodiments between about 0.40 mm and about 4.0 mm, in some embodiments between about 0.50 mm and about 3.0 mm, in some embodiments between about 0.60 mm and about 2.0 mm, in some embodiments between about 0.70 mm and about 1.5 mm, in some embodiments between about 0.80 mm and about 1.4 mm, in some embodiments between about 0.90 mm and about 1.3 mm, and in some embodiments between about 0.95 mm and about 1.2 mm. In some embodiments, each of the plurality of flocked fibers comprises a length of about 1.0 mm.

The manner in which a plurality of flocked fibers is attached to a hair-holding surface is not restricted, and all suitable techniques may be employed. In some embodiments, the flocked fibers are secured to the hair-holding surface via an adhesive. Three representative and non-limiting options for attaching flocked fibers to a hair-holding surface are described below. By way of introduction, Option 1 utilizes an electrostatic application method in which a hair accessory is flocked (with or without prior masking). Option 2 involves designing multi-component hair accessories in which a sub-component is flocked and then assembled with one or more additional sub-components (which themselves may or may not contain flocked fibers) to create the hair accessory. Option 3 involves adhering die-cut fabric and/or textile inserts onto hair accessories or sub-components thereof (which may or may not contain complementary recesses).

In some embodiments, at least a portion of the plurality of flocked fibers is oriented substantially perpendicular to the hair-holding surface. One representative technique for orienting flocked fibers onto a surface in a substantially perpendicular configuration involves depositing flocked fibers onto the surface by an electrostatic flocking process, as further described below in reference to Option 1.

In some embodiments, the layer provided on at least a portion of the hair-holding surface includes a die-cut insert having an adhesive on one side and the plurality of flocked fibers on an opposing side as described below in reference to Option 3. In some embodiments, the portion of the hair-holding surface configured to receive the die-cut insert comprises a recess.

In some embodiments, as described above, the present teachings provide hair accessories. In other embodiments, as further described below, the present teachings also provide methods for manufacturing hair accessories.

By way of example, a method of manufacturing a hair accessory in accordance with the present teachings includes: (a) providing a substrate having a hair-holding surface configured for holding hair, and a structural surface; and (b) applying a layer to at least a portion of the hair-holding surface, wherein the layer includes a plurality of flocked fibers.

In some embodiments based on Option 1, a method in accordance with the present teachings further comprises one or a plurality of the following additional acts: (c) applying an adhesive to the portion of the hair-holding surface that is configured to receive the layer; (d) depositing the plurality of flocked fibers onto the adhesive using an electrostatic flocking process; (e) masking any portion of the substrate that is to remain substantially devoid of flocked fibers prior to applying the adhesive; and/or (f) removing the masking from the substrate after the adhesive has been applied. In some embodiments, the portion of the substrate that is to remain substantially devoid of flocked fibers corresponds to the structural surface, such that the method may include the act of masking the structural surface prior to applying the adhesive.

In some embodiments based on Option 2, the substrate includes a plurality of sub-components configured for detachable assembly to form the hair accessory, and a method in accordance with the present teachings further comprises one or a plurality of the following additional acts: (g) applying adhesive to only a subset of the plurality of sub-components configured to receive the layer; and/or (h) assembling the sub-components to provide the hair accessory after the applying of the layer.

In some embodiments based on Option 3, a method in accordance with the present teachings further comprises applying a die-cut insert having an adhesive on one side and the plurality of flocked fibers on an opposing side to a portion of the hair-holding surface configured to receive the layer. In some embodiments, the hair-holding surface comprises a recess configured to receive the die-cut insert. In other embodiments, the hair-holding surface does not have such a recess. In some embodiments, a method in accordance with the present teachings further comprises applying a die-cut insert having an adhesive on one side and the plurality of flocked fibers on an opposing side to a sub-component of a hair accessory—which, optionally, includes a recess configured to receive the die-cut insert—and then assembling this sub-component together with one or a plurality of other sub-components to form a hair accessory in a manner analogous to Option 2.

Representative embodiments in accordance with the present teachings will now be described in reference to the appended drawings. It is to be understood that elements and features of the various representative embodiments described below may be combined in different ways to produce new embodiments that likewise fall within the scope of the present invention. The drawings and the description below have been provided solely by way of illustration, and are not intended to limit the scope of the appended claims or their equivalents.

Figure 1A:
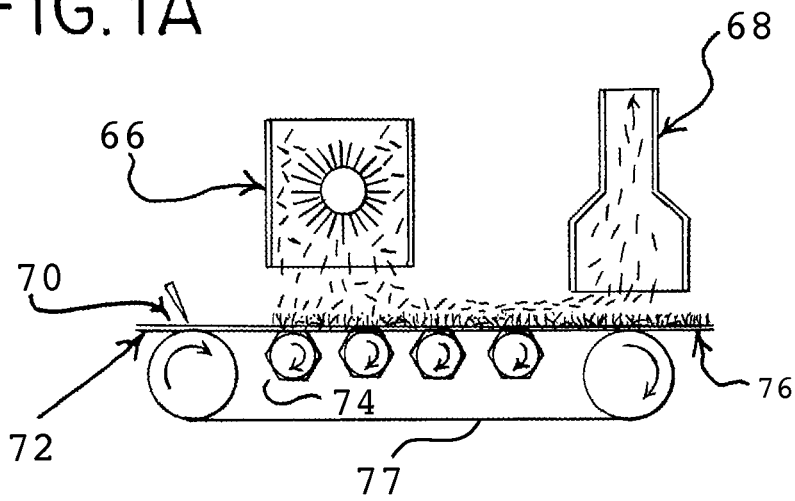
FIG. 1A shows a schematic illustration of a gravity/vibration method for applying flocking fibers to a surface.
Figure 1B:
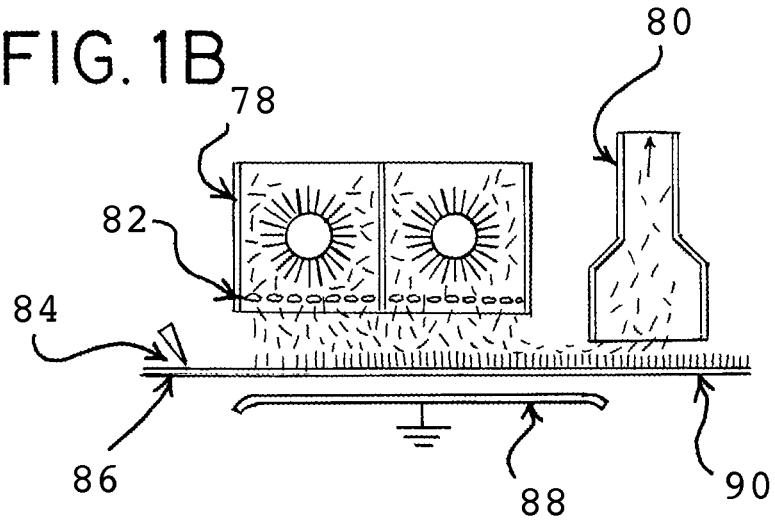
FIG. 1B shows a schematic illustration of an electrostatic method for applying flocking fibers to a surface.
Figure 2:
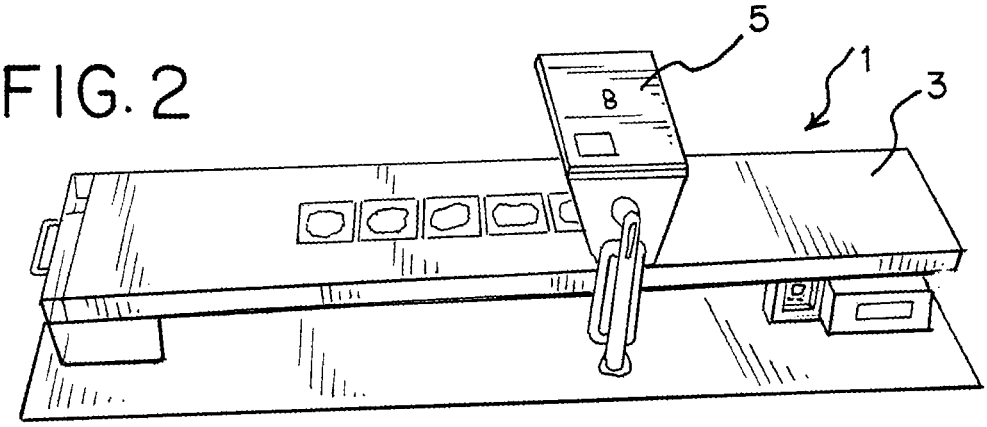
FIG. 2 shows a perspective view of a representative conveyor with an overhead flock hopper.
Figure 3:
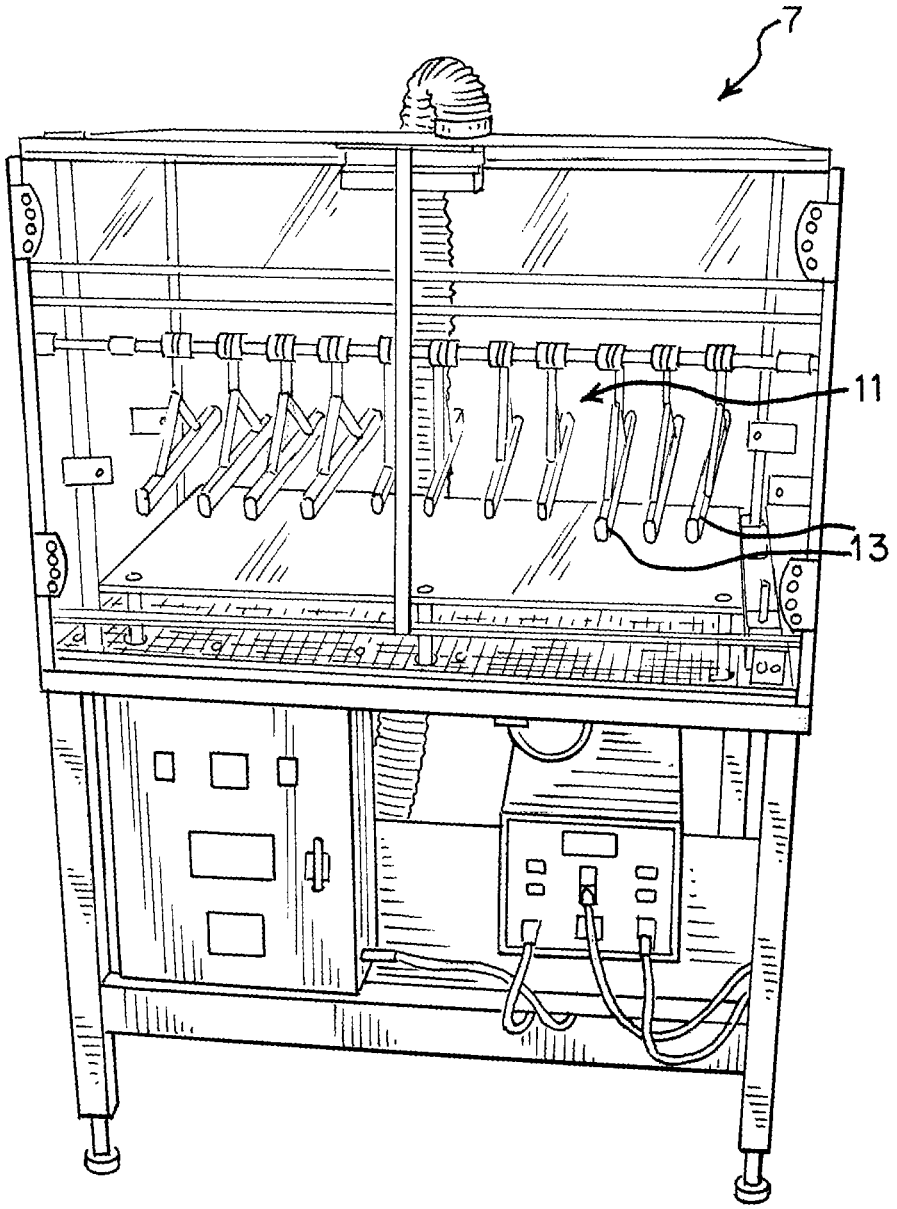
FIG. 3 shows a perspective view of a representative flocking chamber for flocking three-dimensional objects.

FIGS. 1A and 1B show schematic illustrations of, respectively, a gravity/vibration method for applying flocking fibers to a surface and an electrostatic application method. FIG. 2 shows an electrostatic flock applicator 1 that includes a conveyor 3 and an overhead flock hopper 5. FIG. 3 shows an electrostatic flock applicator 7 that includes a flocking chamber 11 suitable for flocking three-dimensional objects 13. The electrostatic flock applicators 1 and 11 shown in FIGS. 2 and 3, respectively, are available from DCA Electrostatics (a division of Campbell Coutts LTD. out of Hampshire, England, hereinafter referred to as "DCA"). These and other electrostatic flock applicators may be used to create a charge in the flock fibers, which are then attracted to a grounded surface to be flocked. Unlike puffer or blown application methods, which merely sprinkle a flock layer onto a surface, electrostatic applications ensure that substantially all of the fibers end up standing at substantially right angles to a surface, thereby resulting in a velvet-like finish.

Figure 4:
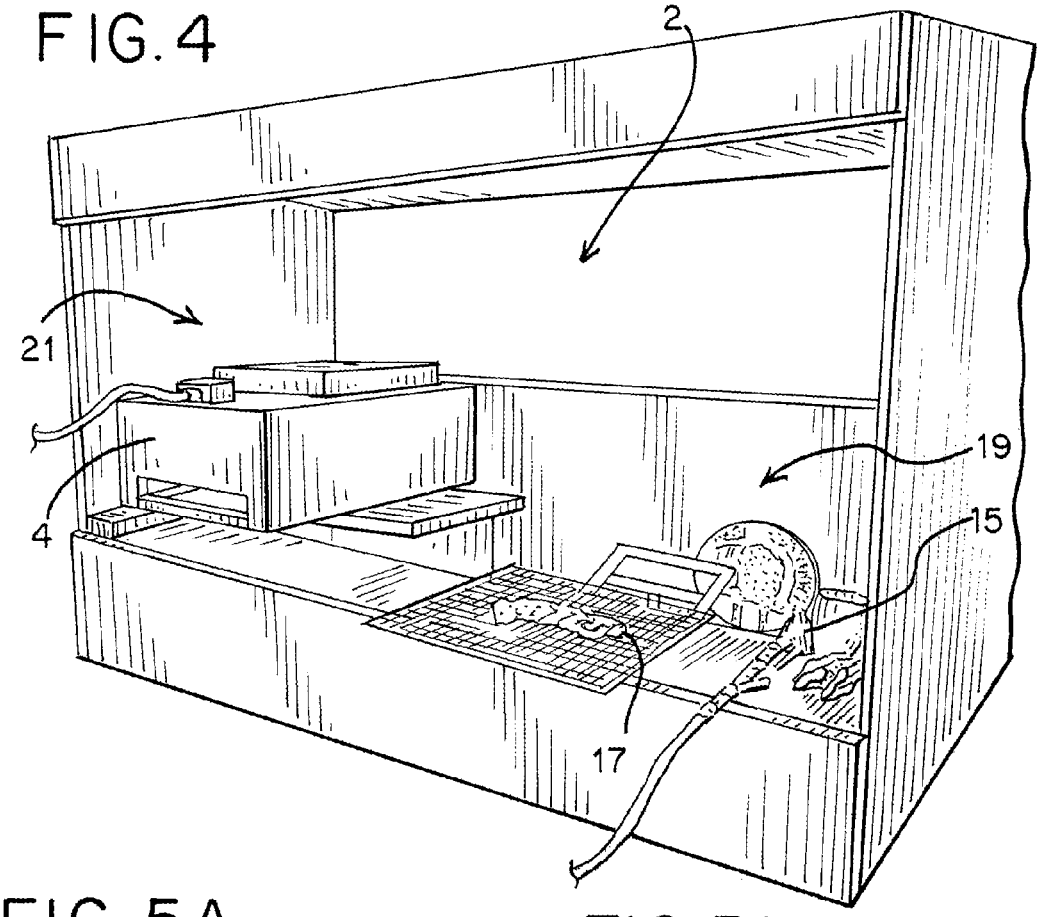
FIG. 4 shows a representative bench-top flocking chamber for spraying adhesive and performing electrostatic flocking.
Figure 5A:
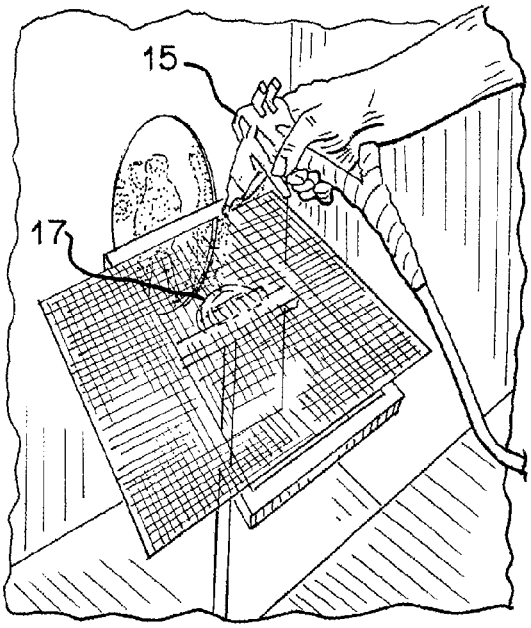
FIG. 5A shows a representative method for applying adhesive to a hair accessory.
Figure 5B:
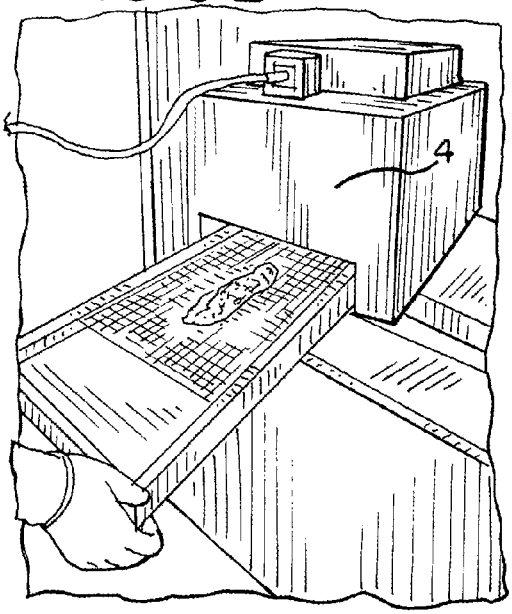
FIG. 5B shows a representative flocking box power unit for performing electrostatic flocking.

In some embodiments, the flock fibers are secured with an adhesive. FIG. 4 shows a representative flocking chamber 2 for spraying adhesive prior to flocking fibers (e.g., nylon fibers) onto the area that is sprayed with the adhesive. FIG. 5A shows an example of applying an adhesive with a spraying device 15 to various hair accessories 17 (e.g., headbands and claw clips). In some embodiments, the adhesive may be thinned down to facilitate spraying. FIG. 5B shows a flocking box power unit 4 that may be turned on to create an electrostatic environment that will cause the flocking fibers to become airborne and coat/penetrate the sprayed-on adhesive layer applied in FIG. 5A. In some embodiments, the flocking chamber 2 shown in FIG. 4 may be used. By way of example, an adhesive may be sprayed on one side of the chamber 19 (e.g., the right side) while an electrostatic flocking operation may be conducted on the other side of the chamber 21 (e.g., the left side).

All manner of adhesives are contemplated for use in accordance with the present teachings and regardless of the manufacturing technique employed (e.g., Option 1, Option 2, and/or Option 3). In some embodiments, the adhesive type is compatible with a variety of plastic resin substrates in order to withstand friction from rubbing on a user's hair and/or rubbing by a user's fingers. In some embodiments, the adhesive is substantially water-resistant, substantially UV-stable, may have a delayed cure time, and/or may have an elastomeric-contributing component, dependent upon the manufacturing process, intended use, and/or the substrate material to which it is being applied. Moreover, in some embodiments, the adhesive may have an ability to carry a charge, such as may be utilized to facilitate electrostatic flocking as described above. In some embodiments, the product quality may be dependent on the manufacturing process. In some embodiments, the manufacturing process may be scalable in order to produce higher quantities and/or to provide process efficiencies associated with lower costs.

Figure 6A:
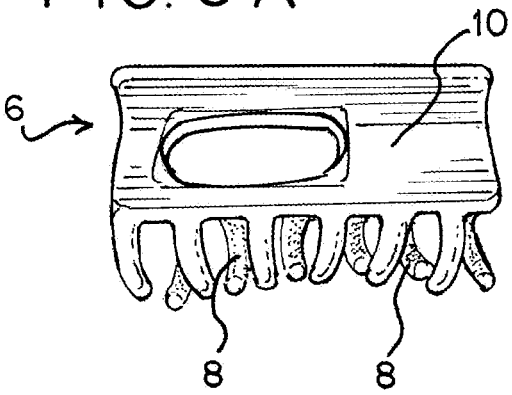
FIG. 6A shows a side perspective view of a first claw clip in accordance with the present teachings, which is shown in a closed position.
Figure 6B:
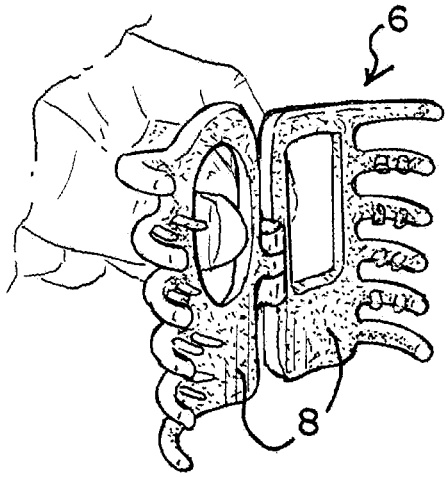
FIG. 6B shows a perspective view of the claw clip of FIG. 6A shown in an open position.
Figure 6C:
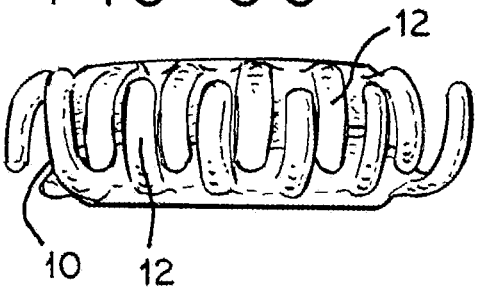
FIG. 6C shows a bottom perspective view of the claw clip of FIG. 6A shown in the closed position.

A bench-top lab environment of a type shown in FIG. 4 has been used to produce multiple prototype samples. FIGS. 6A-6C show a first example of a hair accessory produced in accordance with the present teachings, which is in the form of a claw clip 6. As best shown by FIG. 6B, an interior surface 8 of the claw portion of each claw clip half is flocked to assist in holding hair. As best shown by FIGS. 6A and 6C, external (e.g., structural) surfaces 10 of the claw clip 6 are substantially devoid of flocking. Since flocking material does not extend completely around teeth 12 of the claw clip 6, these teeth 12 are able to more readily slide into and through hair.

Figure 7:
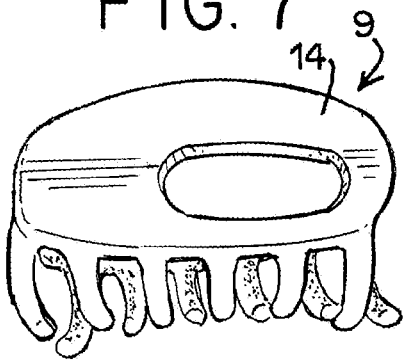
FIG. 7 shows a side perspective view of a second claw clip in accordance with the present teachings, which is shown in a closed position.

FIG. 7 shows a second example of a hair accessory in accordance with the present teachings, which is also in the form of a claw clip 9. The claw clip 9 of FIG. 7 is analogous to the claw clip 6 of FIGS. 6A-6C apart from a different configuration in its external (e.g., structural surfaces) 14.

Figure 8A:
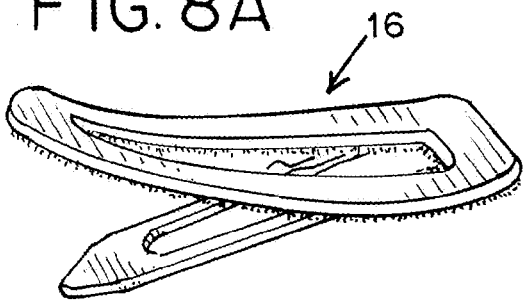
FIG. 8A shows a top perspective view of a contour clip in accordance with the present teachings, which is shown in an open position.
Figure 8B:
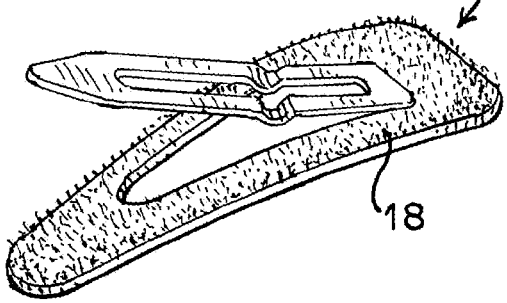
FIG. 8B shows a bottom perspective view of the contour clip of FIG. 8A.

FIGS. 8A and 8B show a third example of a hair accessory in accordance with the present teachings, which is in the form of a contour clip or a snap clip 16. As best shown by FIG. 8B, an underside 18 of the contour clip 16 is provided with flocking material to assist in holding hair.

Figure 9A:
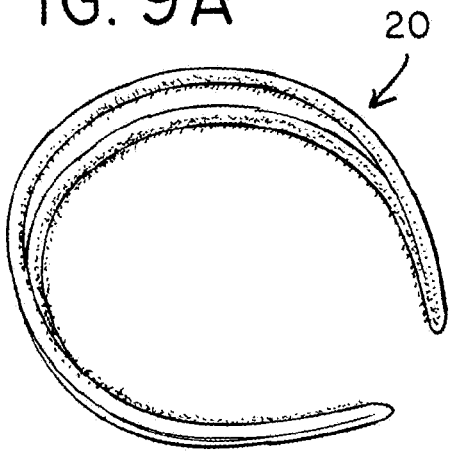
FIG. 9A shows a perspective view of a first hard headband in accordance with the present teachings.
Figure 9B:
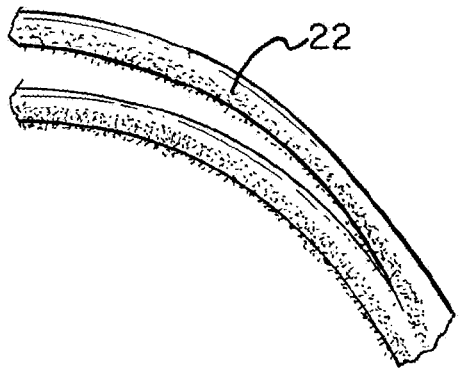
FIG. 9B shows a detail of an interior hair-holding surface of the hard headband of FIG. 9A.

FIGS. 9A and 9B show a fourth example of a hair accessory in accordance with the present teachings, which is in the form of a hard headband 20. As best shown by FIG. 9B, an underside 22 of the hard headband 20 is provided with flocking material to assist in holding hair.

Figure 10A:
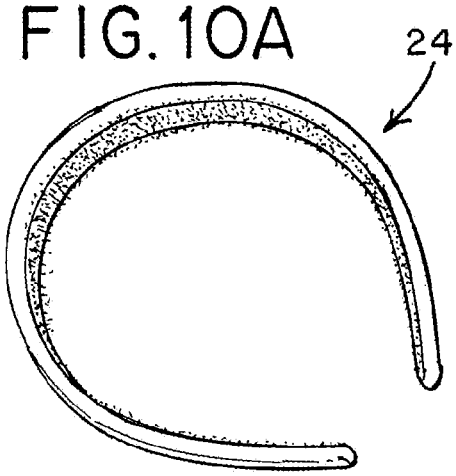
FIG. 10A shows a perspective view of a second hard headband in accordance with the present teachings.
Figure 10B:
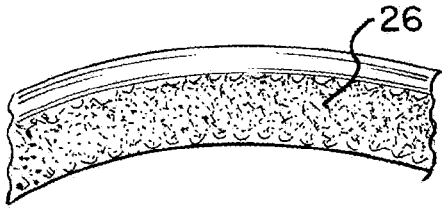
FIG. 10B shows a detail of an interior hair-holding surface of the hard headband of FIG. 10A.

FIGS. 10A and 10B show a fifth example of a hair accessory in accordance with the present teachings, which is also in the form of a hard headband 24. As best shown by FIG. 10B, an underside 26 of the hard headband 24 is provided with flocking material to assist in holding hair. The hard headband 24 of FIGS. 10A and 10B is analogous to the hard headband 20 of FIGS. 9A and 9B. In the headband 24 shown in FIGS. 10A and 10B (and, indeed, for any hair accessory in accordance with the present teachings), fibers of a certain color (e.g., brown) may be used to flock a similarly colored substrate in order to achieve a "tone-on-tone" aesthetic.

Figure 11A:
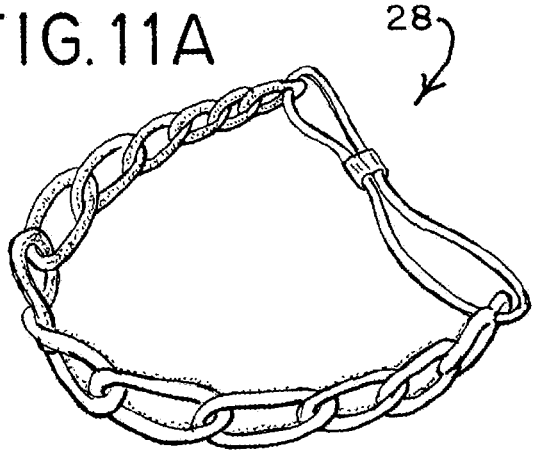
FIG. 11A shows a top perspective view of a PVC "jelly" head wrap in accordance with the present teachings.
Figure 11B:
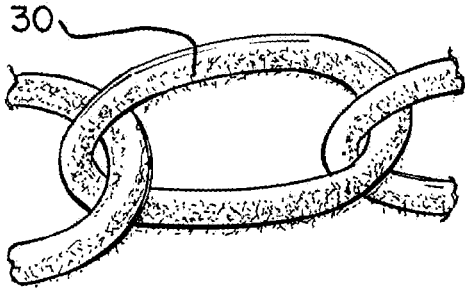
FIG. 11B shows a detail of an interior hair-holding surface of the PVC "jelly" head wrap of FIG. 11A.

FIGS. 11A and 11B show a sixth example of a hair accessory in accordance with the present teachings, which is in the form of a PVC "jelly" head wrap 28. As best shown by FIG. 11B, an underside 30 of the head wrap 28 is provided with flocking material to assist in holding hair.

In some embodiments, the flocking fiber material includes nylon. In other embodiments, the flocking fiber material includes cotton, rayon, polyester, or the like, or combinations thereof. In some embodiments, the flock fiber is milled and, in other embodiments, the flock fiber is cut. In some embodiments, milled flock may be produced from cotton and/or synthetic textile waste material. As a result of the manufacturing process, milled flock is typically not uniform in length and, in some embodiments, may vary from fine (e.g., between about 0.4 mm and about 0.5 mm) to coarse (e.g., between about 0.4 mm and about 1.1 mm). Cut flock is typically produced only from monofilament synthetic materials, and the cutting processes may produce substantially uniform lengths of flock fibers. In some embodiments, lengths from about 0.3 mm to about 5.0 mm are obtained. In some embodiments, such fibers may have diameters from about 1.7 dtex to about 22 dtex. One dtex is the measurement of a fiber tex. A decitex is a linear mass density of fibers, which is the mass in grams per 10,000 meters of the fiber. The diameter of a filament may be calculated given its weight in dtex using the following formula:

$$\phi = \sqrt{\frac{4 \times 10^{-6} * dtex}{\pi \rho}}$$

The softness of a flocking may be determined by the fineness of the flock, the length of the fibers, and/or the adhesive coating density. In some embodiments, in addition to cutting or milling, flock manufacturing may include additional processing. By way of example, after cutting, the flock may be cleaned of oils that accumulated during processing. The fibers are typically vat-dyed to any number of colors, and then chemically treated to enable the fibers to accept an electrical charge. Since substantially all of the fibers are dielectric, a certain amount of conductivity is typically needed to facilitate an electrostatic flocking process. When the dying and charging processes are complete, the fibers may be spin-dried and then oven-dried to achieve a desired moisture content. In some embodiments, flocking fibers are not completely dried, since moisture content adds to their conductivity. In some embodiments, nylon flocking fibers having a length of about 1 mm are used.

The application of the flocking fiber to a hair accessory substrate material may be accomplished using a number of different application methods. These methods, which are further described below, include but are not limited to a beater bar/gravity method as shown in FIG. 1A, an electrostatic method as shown in FIG. 1B, spraying techniques, and transfer application techniques.

In some embodiments, flocking material may be applied by printing an adhesive onto a substantially flat substrate, and then rapidly vibrating the substrate (e.g., mechanically) while the flock fibers are distributed over the surface. The vibration promotes the density of fibers, which may contribute to a good fiber coating, and causes the flocking fibers to adhere to the adhesive and pack into a layer. This mechanical process is shown schematically in FIG. 1A, wherein the following elements are depicted: flock hopper 66; suction column for removing excess flock 68; adhesive 70; adhesive-coated fabric 72; beater bars 74; flock covered fabric 76; and supporting conveyor belt 77. In the beater bar or gravity flocking method depicted in FIG. 1A, flocking fibers are randomly adhered to the surface of a substrate. In some embodiments, each fiber may adhere to the adhesive at a different depth, thereby creating an irregular flocked surface. In some embodiments, since the fibers may adhere to the surface of the adhesive, as opposed to penetrating or becoming imbedded in the adhesive, some fiber shedding may occur, depending on how the flocked product is used. Since loose flocking fibers generated during production have a tendency to migrate, it may be desirable in some embodiments to install these types of systems in a separate area to prevent fiber contamination of the factory.

In some embodiments, flocking material may be applied by an electrostatic application method, as shown schematically in FIG. 1B, wherein the following elements are depicted: flock hopper 78; suction column for removing excess flock 80; positive electrode grid 82; adhesive 84; adhesive coated fabric 86; grounded electrode 88; and flock covered fabric 90. An electrostatic application method enables the flock fiber to stand substantially perpendicular to the substrate material with some consistency. Thus, in some embodiments, an electrostatic application method is well suited for the manufacture of hair accessories in accordance with the present teachings. Electrostatic flocking equipment, such as that shown in FIGS. 2, 3, 4, and 5B, operates using similar basic procedures, and may be explained by a law of physics stating that opposing electrical charges attract. In electrostatic flocking, an electrical charge is generated by the use of two electrodes: a high voltage, direct current grid connected to a power generator, and a grounded substrate. An electrostatic charge is generated that propels the fibers at high velocity onto the adhesive-coated and grounded substrate. This propulsion may cause the flocking fibers to penetrate and imbed in the adhesive at right angles to the substrate, thereby forming a high density, substantially uniform flock coating or layer. Controlling the electrical field by increasing or decreasing either the applied voltage or the distance between the electrodes and the substrate facilitates control over the speed and thickness of the flocking material.

In some embodiments, flocking material may be sprayed using an air compressor, reservoir, and/or spray gun in a manner analogous to spraying paint. The resultant finish obtained by such a method is similar to a thin felt coating since most of the fibers will be lying down in the adhesive. As a result, this method may not produce a very soft tactile surface texture which, in some embodiments, may be desirable and, in other embodiments, may be undesirable. In some embodiments, such as when large areas are to be flocked, the spraying method may be used. Typically, the spraying method is an untidy process since some of the flocking fibers may become airborne.

In order to control the application of adhesive to a hair accessory and prevent undesirable application of adhesive to areas of the hair accessory that are not intended for flocking (e.g., as a result of over-spraying of the adhesive), areas of the hair accessory that are to be protected from possible exposure to adhesive overspray may be masked. In some embodiments, including but not limited to methods of manufacturing a hair accessory based on Options 1 and 2, the hair accessory component may be masked to permit the application of flocked fibers (e.g., nylon) to form a flocked fiber layer on an interior of the hair accessory. In some embodiments, masking fixtures may be used so that only those portions of the hair accessory to receive a flocked fiber layer will be exposed. Representative masking fixtures for masking various types of hair accessories that may be used in accordance with the present teachings include but are not limited to those shown in FIGS. 12A-12C, 13A-13B, 14A-14C, and 15A-15D.

FIG. 12A shows an example of a masking fixture 32 that, in some embodiments, may be used for covering areas of a claw clip that are not intended to receive a layer of flocking fibers. FIGS. 12B and 12C show detail views of the masking fixture 32 in an open position. One side of a claw clip half (not shown) is configured to sit inside the fixture 32 on a supporting surface 23, as shown in FIG. 12A, thereby exposing only that area of the claw clip half that is to receive the adhesive spray through an opening 25 shown in FIG. 12B. After spraying with an adhesive, the clip may be removed from the masking fixture 32 and placed onto a metal grate (or other suitable surface) for the fiber flocking application.

FIG. 13A shows an example of a masking fixture 34 that, in some embodiments, may be used for covering areas of a headband that are not intended to receive a layer of flocking fibers. FIG. 13B shows the masking fixture 34 in an opened position. In some embodiments, a flat headband (not shown) may be positioned inside of the masking fixture 34 in order to mask an exterior portion of the headband that is not to receive a layer of flocking fibers and, therefore, is not to be exposed to an adhesive spray. As shown in FIG. 13B, the flat headband may be placed inside the fixture 34 on a supporting surface 27, thereby exposing only that area of the headband that is to receive the adhesive spray through an opening 29 in the fixture 34.

Figure 14A:
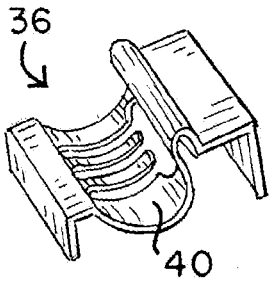
FIG. 14A shows a top perspective view of a third representative masking fixture.
Figure 14B:
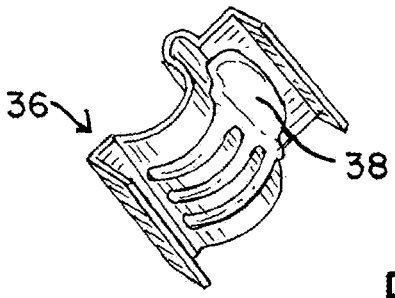
FIG. 14B shows a bottom perspective view of the masking fixture of FIG. 14A together with a sub-component to be masked.
Figure 14C:
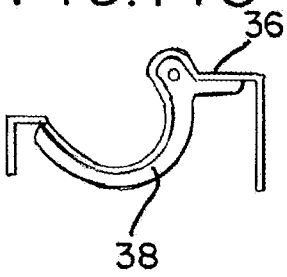
FIG. 14C shows a side elevation of the masking fixture of FIG. 14B together with the sub-component.

FIG. 14A shows an example of a masking fixture 36 that, in some embodiments, may be used for exposing interior areas of a claw clip half 38 that are to be coated with an adhesive, and for masking off other areas of the claw clip half that are not to be coated with adhesive. In some embodiments, the masking fixture 36 may be constructed from vacuum-formed plastic and milled to remove areas for adhesive application. In other embodiments, the masking fixture 36 may be formed from a metal and likewise milled or die-cut to remove areas for adhesive application. FIG. 14A shows a side 40 of the masking fixture 36 on which adhesive is desired. FIG. 14B shows the claw clip half 38 nested underneath or behind the masking fixture 36. FIG. 14C shows a side view of the masking fixture 36 and the claw clip half 38.

Figure 15A:
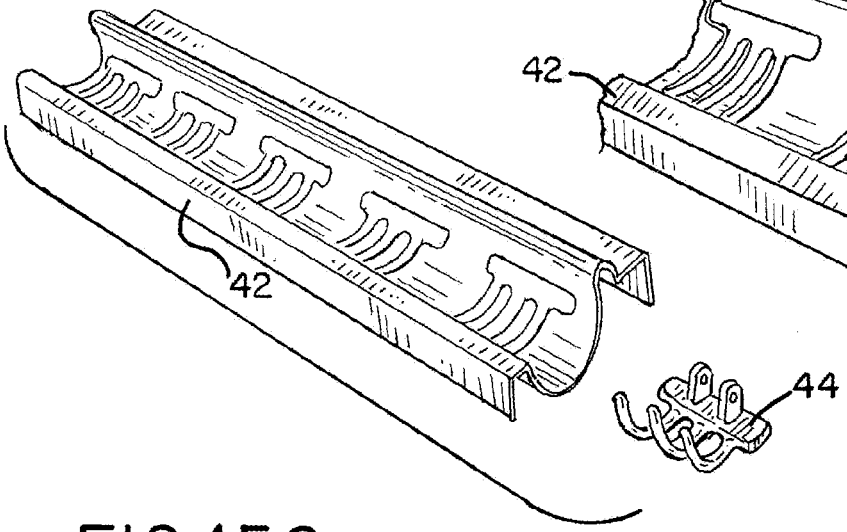
FIG. 15A shows a top perspective view of a fourth representative masking fixture, which is configured for masking multiple sub-components.
Figure 15B:
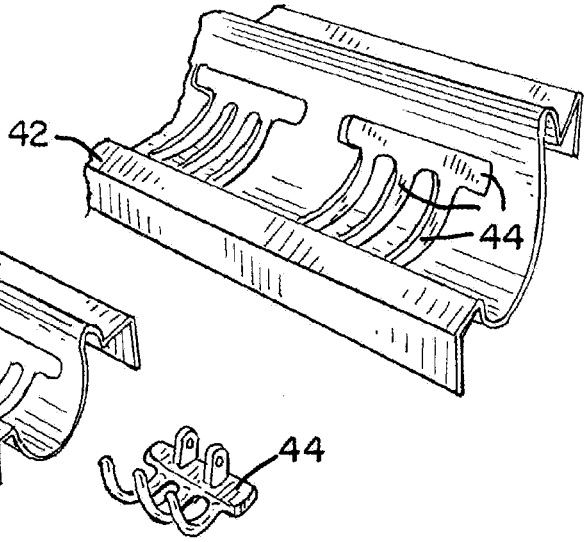
FIG. 15B shows a detail of the masking fixture of FIG. 15A with a sub-component positioned for masking.
Figure 15C:
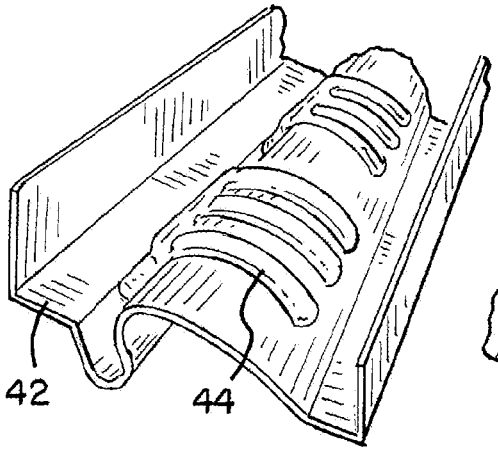
FIG. 15C shows a bottom perspective view of the masking fixture of FIG. 15A together with a sub-component to be masked.
Figure 15D:
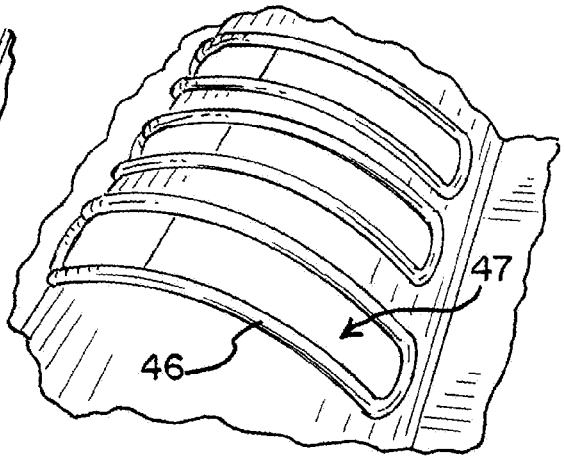
FIG. 15D shows a detail of the masking fixture of FIG. 15C.

FIG. 15A shows an example of a masking fixture 42 that, in some embodiments, may be used for exposing interior areas of multiple claw clip halves that are to be coated with an adhesive, and for masking off other areas of the multiple claw clip halves that are not to be coated with adhesive. FIGS. 15B and 15C show a claw clip half 44 positioned behind the masking fixture 42 in preparation for an application of an adhesive spray. As best shown by FIG. 15D, the masking fixture 42 may include a raised portion 46 nearest the orifice 47 to prevent overspray of the adhesive. In some embodiments, the raised portion 46 may be a flexible elastomer (e.g., a thermoplastic elastomer (TPE); vinyl; etc.) that would bear up against the hair accessory to essentially seal the edge from overspray.

In some embodiments, a semi-automated flocking line may be developed in which an adhesive is first sprayed onto a masked hair accessory followed by removal of the masking fixture. The adhesive-coated hair accessory may then move through a flocking chamber in which flocking fibers (e.g., 1 mm nylon fibers) may be electrostatically imbedded in and secured to the adhesive-coated hair accessory. In some embodiments, it may be beneficial to have a flocking chamber that is a removable cell so that each flocking chamber may be filled with a designated color for production. In such a way, when a fiber color is to be changed from one run to a next, the operator need only roll out one flocking cell (e.g., one for black flocking material) and roll in another flocking cell containing a different desired color (e.g., a brown flocking material), thereby shortening production line down time by eliminating the considerable time needed to clean out a stationary flocking chamber of all its fibers of one color prior to commencing a subsequent run using different-colored fibers.

In some embodiments based on Option 1 or Option 2, the flocked hair accessories or sub-components thereof, upon exiting the flocking chamber, may be subjected to a process to remove excess fibers (e.g., by placing the flocked parts on a vibration table). In addition, in some embodiments, the samples, after having been flocked, may be placed in an oven to cure the adhesive. In some embodiments, the curing oven is maintained at about 80° C. and the flocked hair accessories or sub-components thereof may be cured for between about 20 minutes and about 30 minutes. In some embodiments, the flocked products may be left to "air-dry" over a period of time (e.g., about 24 hours).

In some embodiments, the environment in which the flocking chamber resides may affect the flocking process. In some embodiments, it is possible to control characteristics of the environment in order to obtain optimal adhesion of the flocked fibers in the adhesive. In some embodiments, the flocking chamber has a relative humidity of about 60% and a temperature of about 20° C. (68° F.). In some embodiments, a small variation in temperature or a change in the percentage of relative humidity may result in a three-fold to four-fold change in the conductivity or electrical sensitivity of the flock fibers and the substrate. In some embodiments, such changes may adversely affect the process and, in some embodiments, may result in flock balling, reduced adhesion, problems with density of the flocking, and/or excessive use of flock material. Flocking fibers are typically very sensitive to humidity and temperature conditions. Thus, when a new batch of flock fibers is opened, the fibers tend to lose or receive moisture based on their surrounding environment. By way of example, less than about 30% relative humidity in the production chamber may result in flock fibers that do not accept a charge. Conversely, relative humidity in excess of about 65% may cause the flock fibers to stick together and flow poorly through a metal screen or plate. Thus, in some embodiments, best results are obtained when the flocking operation is conducted in an atmospherically controlled room.

In some embodiments, the durability of a layer of flocked fibers is dependent on the nature of the adhesive that is used to adhere the fibers to the substrate. A list of representative adhesives is shown in Table 1.

TABLE 1

List of Adhesives

| Adhesive | Materials it can be used on | Solvent | Curing | Open time | Additional Notes |
|---|---|---|---|---|---|
| 9888 Vinyl | General purpose adhesive, particularly suitable for use on vinyl and PVC | Water | Air Dry | 5 mins | Water resistant to cool and warm waters |
| 5399 Aqueous Polyurethane | General purpose adhesive, often used on wood | Water | Air Dry | 10 mins | Durable Waterproof Stain resistant Solvent free |
| 5118 EVA | Board, wood, carpeting materials, felt, fabrics, polyester, polystyrene and PVC | Water | Air Dry | | Specifically formulated for screen-printing, but can also be applied with roller, brush or spray. Water-resistant Heat-resistant Scrub resistant when dried |
| F5716 Acrylic | General purpose adhesive suitable for most surfaces board, concrete, some metals, some plastics, concrete ceramics, wood, wood composites, carpet, felt and fabrics | Water | Air Dry | 5 mins | Versatile Durable Good water and humidity resistance Flexible when set |
| Epoxy (CPR5/CPH5) | Car dashboards All materials, including metal (due to its rigidity when cured, it is not recommended for use on fabrics) | Acetone | 20° C. = 24 hrs 70° C. = 3 hrs | 40 mins | Waterproof Working temperatures of up to 120° C. Flame resistant |
| Flame Retardant Epoxy (FRR5/FRH5) | Car dashboards All materials, including metal (due to its rigidity when cured, it is not recommended for use on fabrics) | Acetone | 20° C. = 24 hrs 70° C. = 3 hrs | 40 mins | Waterproof Working temperatures of up to 120° C. Flame Retardant |
| Sericol OP395 | Almost all textiles, papers and boards | Plastisol Flow Thinner Or Tursub | 160° C. = 2-3 mins 140° C. = 5-6 mins | 2 hrs | Durable Waterproof Washable Flexible when cured |

While neither desiring to be bound by any particular theory nor intending to limit in any measure the scope of the appended claims or their equivalents, it is presently believed that 9888 Vinyl, 5399 Aqueous Polyurethane, and 5118 EVA may yield a less durable product in quality rub/durability tests when tested on a braided elastic headband. In some embodiments, adhesives such as DCA #619 AquaFlex latex adhesive and Revacryl 272 Aqueous Acrylic adhesive may be used. It is appreciated that the foregoing examples are not intended to limit the scope of the embodiments described herein, and that adhesives from other sources, new adhesives as-yet-to-be-developed, and/or combinations of any adhesive, substance, component, or desired property described herein may be used. In some embodiments, an acrylic acid polymerization glue that contains water-resistant additives may be used. In some embodiments, the percentage of the water-resistant ingredient may be adjusted to optimize results. In some embodiments, an adhesive in accordance with the present teachings may include a styrene-acrylic copolymer. In some embodiments, the adhesive used in accordance with the present teachings includes a water-resistant ingredient along with one or a plurality of UV stabilizers. In some embodiments, the adhesive may be selected and/or formulated to have a delayed cure time (e.g., to facilitate the production process since, in some embodiments, a substrate may be sprayed in one location and transferred to another location for flocking). In some embodiments, the adhesive may be selected and/or formulated to have an elastomeric-contributing component. In some embodiments, the adhesive may be selected and/or formulated to have an ability to carry a charge, such as may be utilized to facilitate electrostatic flocking as described above. It is appreciated that the selection or formulation of adhesives utilized may in large part be dependent upon the manufacturing process, intended use, intended results, and/or the substrate material to which it is being applied.

In some embodiments based on Option 2, one or more injection-molded sub-components of a hair accessory may be flocked (e.g., with nylon fibers) and then assembled with other sub-components to form the hair accessory (e.g., a claw clip). FIG. 16 shows an example of a flocked sub-component 48 of a hair accessory in accordance with the present teachings (e.g., a flocked claw clip half).

FIG. 17 shows prototypes of a claw clip hair accessory formed by a method based on Option 2. In FIG. 17, a molded plastic to-be-flocked insert component 50 and a claw clip half 52 are shown prior to flocking of insert 50 and prior to assembly. In some embodiments, glue or built-in snaps may be used to secure a previously flocked insert piece into or onto a molded claw clip half. Analogous methods may be used for forming other hair accessories as well, including but not limited to headbands, auto clasps, contour clips, jean wires, other claw clip designs, and the like, and combinations thereof.

In some embodiments based on Option 2, the sub-components of a hair accessory may be easier to flock than the fully assembled hair accessory. In some embodiments, individual flocking of a sub-component may also facilitate controlled parting lines between the flocked and non-flocked sub-components of the hair accessory. In some embodiments based on Option 2, concern regarding potential over-spray of adhesive onto an area of the hair accessory that is not to be flocked may be reduced and/or eliminated. In some embodiments, methods based on Option 2 may involve designing hair accessories to include sub-components and involve separate tooling for the new inserts. By contrast, in some embodiments, methods based on Option 1 may use conventional hair accessory component tooling without substantial modification or addition.

Although in some embodiments, hair accessories in accordance with the present teachings made by methods based on Option 1 or Option 2 may be able to withstand quality rub/durability performance specifications developed for dry conditions, it is presently believed that the specifications developed for dry conditions may differ from those developed for wet conditions (e.g., which may occur as a result of a hair accessory coming into contact with wet hair, being worn in the rain, etc.).

In methods based on Option 3, the use of a die-cut insert cut from an existing velvet, suede, and/or velour (and/or velvet-like, suede-like, and/or velour-like) fabric and/or textile material avoids the use of a flocking fiber manufacturing process and, in some embodiments, may allow for greater ease and flexibility. In some embodiments, the fabric and/or textile material may be a conventional woven fabric. In some embodiments, the woven fabric may be velvet. Velvet is a type of tufted fabric in which the cut threads are evenly distributed with a short dense pile that has a distinct feel. Velvet may be made from virtually any fiber, and is typically woven on a special loom that weaves two pieces of velvet at the same time. The two pieces are then cut apart and the two lengths of fabric are wound on separate take-up rolls. Traditionally, velvet is made entirely of silk fiber, but modern velvet may be woven from a variety of natural or synthetic warp yarns. Materials such as cotton, nylon, acrylic, rayon, polyester, and the like are often used. In some embodiments, the woven fabric is velour. Velour is a type of fabric and/or textile material that is a knitted counterpart to velvet. Velour combines the stretchy properties of knits (e.g., spandex) with the appearance and feel of velvet. All manner of such fabrics and/or textiles—including but not limited to velvet, suede, and/or velour—may be used in accordance with Option 3 of the present teachings even when the hair accessory component to which the fabric die-cut insert is to adhere has a complex three-dimensional shape and/or contour.

In methods based on Option 3, conventional designs of hair accessories may be modified to include a recess configured to receive and adhere to a die-cut insert of a fabric and/or textile material. FIG. 18A shows the backing paper 54 of a representative die-cut insert 56 being peeled back to expose an adhesive layer 58 configured for assembly into a complementary recess of a claw clip. FIG. 18B shows a recess 60 on an interior side of a claw clip half 62 into which the die-cut insert may be placed and adhered. FIG. 19 shows the claw clip half 62 of FIG. 18B with the die-cut insert 56 placed and adhered in the recess 60 of the claw clip half 62. FIGS. 20A and 20B show a fully assembled claw clip 64 formed by a method based on Option 3, which was assembled from two individual claw clip halves 62, such as those shown in FIG. 19.

In some embodiments based on Option 3, conventional hair accessories may be modified to include a recess in a surface that is to include a fabric and/or textile layer. The die-cut inserts may be provided with an adhesive on one side that is covered with a peel-off backing paper, as shown in FIG. 18A. In some embodiments, the die-cut insert may be placed in the recess to achieve the desired internal flocked surfaces of the hair accessory.

In some embodiments based on Option 3, conventional designs and/or tooling for the hair accessory sub-components may be modified to create a recess. In some embodiments, a die-cut fabric and/or textile insert may be placed within the recess. In some embodiments, the recess protects the edge of the insert from being easily removed by fingernails. In some embodiments, the inserts are adhered directly to a surface of an existing hair accessory component that lacks any such recess.

In some embodiments based on Option 3, the adhesive used to secure the die-cut insert in place will adhere to a variety of plastic resins, including but not limited to ABS, PS, SAN, PP, Acrylic, HIPS, K-RESIN, Polycarbonate, KOSTRATE, nylons, and the like, and combinations thereof. In some embodiments, the adhesive is liquid glue similar in consistency to rubber cement, which does not have a tendency to wick to the fiber side of the fabric and/or textile material, thereby causing the fibers to lose their soft tactile feel. In some embodiments, the adhesive may be sprayed-on in a manner analogous to the process described above in connection with flocking adhesives and similar to a 3M Spray 77 adhesive. In some embodiments, a double stick adhesive with a backing paper may be applied to the back of a fabric and/or textile, which is then die cut and peeled away prior to installation in a recess. The type of double-stick adhesive used in this application is not restricted, with representative double-stick adhesives including but not limited to 3M adhesive nos. 9485PC, 6035PC, 6038PC, and/or the like, and combinations thereof. In some embodiments, the adhesives stay flexible after application and do not have a tendency to wick into the fabric and/or textile fibers.

In some embodiments based on Options 1 and 2, the density or amount of flocked fibers may be a factor in providing optimum hair grip. In some embodiments, the more fibers and surface area exposure of a hair accessory, the more likely it is that hair will become intertwined within the multiple fibers, thereby corresponding to an improved hold by the hair accessory. In some embodiments, the base substrate of the hair accessory will be clear or tinted (e.g., a tortoiseshell finish) in which light may pass through the substrate. In such embodiments, the hair accessory may be held up to the light in order to inspect flocking density of the fibers and to ensure even coverage.

In some embodiments based on Option 1, the flocking fiber density is dependent on the type of adhesive used and the amount of time that the hair accessory is placed in an electrostatic chamber. Typically, a longer flocking time corresponds to a greater density of flocked fibers. Generally speaking, flock density of fibers should be judged after the loose fibers are shaken off and removed in order to determine if a proper amount of fibers has been secured to the hair accessory. Samples with a heavy fiber density have been pull-tested and compared to samples with a light fiber density. The results indicate that a heavier-flocked fiber density corresponds to an increase in the potential hold of the hair accessory on hair.

In some embodiments, methods based on Option 1, in which a substrate is optionally masked and then flocked, may be best suited for manufacturing hair accessories exhibiting desired hair-holding and performance results in accordance with the present teachings. Moreover, for methods based on Option 1, existing hair accessory designs and tooling may be used. In some embodiments, a method of flocking in accordance with Option 2 is used, wherein separate sub-components are designed and engineered, and wherein only a subset of the sub-components is flocked before the full array of sub-components is assembled together to create the hair-accessory. In some embodiments, a method of flocking in accordance with Option 3 is used in which die-cut fabric and/or textile materials are adhered to a surface of a hair accessory component.

A further method of application for creating flocked braided elastic bands may be used as an alternative to a Maypole braiding machine and differs from the flocking methods described above. For example, the new manufacturing method may involve injection molding elastic band material with in-mold decorated films, such as of Lextra-Stretch graphics. Lextra-Stretch is a material the provides similar aesthetic and tactile characteristics to a velvet-flocked material on a braided elastic substrate, but provides opportunities to produce multiple patterns and up to six colors in potentially much higher volumes. In some embodiments, updating graphics in such a process would be easier and, moreover, provide an opportunity for on-product branding.

Figure 21:
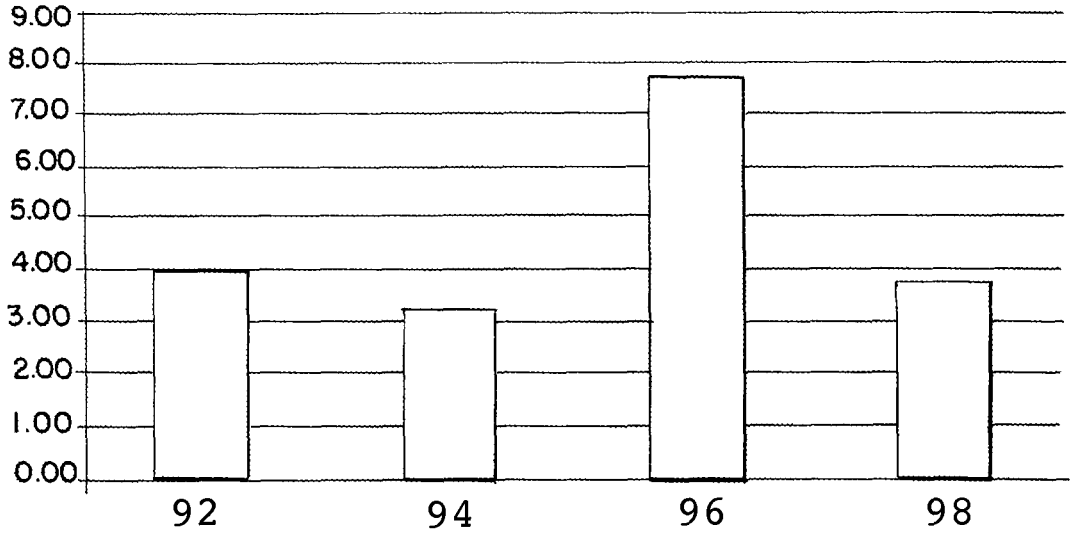
FIG. 21 shows data for pull force testing of medium quarter claw clips in accordance with the present teachings as compared to other claw clip designs.

Pull force competitive testing to determine the amount of force required to move a hair accessory 1" down a ponytail was performed. The competitive testing data are summarized in the bar graph shown in FIG. 21, wherein the y-axis depicts average force. FIG. 21 shows data for pull force testing of a medium quarter claw clip in accordance with the present teachings (graph 96—the third graph from the left) as compared to three other similarly-sized and similarly-shaped medium quarter claw clip designs with or without TPE lining. The three claw clips that were used in the comparison study are as follows: "Scunci Flat NSG Claw Clip Medium" 92; "Goody Slide Proof Claw Clip TPE Medium" 94; and "Goody Medium Classic Claw Clip" 98. As shown by graph 96, a nylon-flocked hair accessory in accordance with the present teachings—surprisingly and unexpectedly—provides substantially better hair hold than three conventional medium quarter claw clips.

As shown by the data in FIG. 21, a nylon-flocked hair accessory in accordance with the present teachings—surprisingly and unexpectedly—provides much better hold in hair than similarly-sized and similarly-shaped conventional hair accessories. Moreover, surprisingly and unexpectedly, hair accessories in accordance with the present teachings have also been described by product testing participants as being gentler on their hair and causing less damage to their hair upon removal. This reduction in damage is a key purchasing component for many multi-cultural and thinning hair users. Thus, in some embodiments, surprisingly and unexpectedly, a hair accessory in accordance with the present teachings provides a stronger hold on hair compared to conventional products while also feeling gentler and causing less damage to hair.

The foregoing detailed description and the accompanying drawings have been provided by way of explanation and illustration, and are not intended to limit the scope of the appended claims. Many variations in the presently preferred embodiments illustrated herein will be apparent to one of ordinary skill in the art, and remain within the scope of the appended claims and their equivalents.

It is to be understood that the elements and features recited in the appended claims may be combined in different ways to produce new claims that likewise fall within the scope of the present invention. Thus, whereas the dependent claims appended below depend from only a single independent or dependent claim, it is to be understood that these dependent claims can, alternatively, be made to depend in the alternative from any preceding claim—whether independent or dependent—and that such new combinations are to be understood as forming a part of the present specification.

The invention claimed is:

1. A method of manufacturing a hair accessory comprising:

providing a substrate having a hair-holding surface configured for holding hair, and a structural surface; and applying a layer to at least a portion of the hair-holding surface, wherein the layer comprises a plurality of flocked fibers, the plurality of flocked fibers having been attached to the layer at a temperature of about 20° C. and at a relative humidity of between about 30% and about 65%.

2. The method of claim 1 further comprising applying an adhesive to the portion of the hair-holding surface configured to receive the layer.

3. The method of claim 2 further comprising depositing the plurality of flocked fibers onto the adhesive using an electrostatic flocking process.

4. The method of claim 2 further comprising masking any portion of the substrate that is to remain substantially devoid of flocked fibers prior to applying the adhesive.

5. The method of claim 2 further comprising masking the structural surface prior to applying the adhesive.

6. The method of claim 1 wherein the substrate comprises a plurality of sub-components configured for detachable assembly to form the hair accessory.

7. The method of claim 6 further comprising applying adhesive to only a subset of the plurality of sub-components configured to receive the layer.

8. The method of claim 7 further comprising assembling the sub-components to provide the hair accessory after the applying of the layer.

9. The method of claim 1 further comprising applying a die-cut insert having an adhesive on one side and the plurality of flocked fibers on an opposing side to the portion of the hair-holding surface configured to receive the layer.

10. The method of claim 3 further comprising applying at least a partial electric charge to at least a portion of the substrate and/or at least a portion of the adhesive, thereby facilitating the depositing of the plurality of flocked fibers onto the adhesive using the electrostatic flocking process.

11. The method of claim 1, wherein the flocked fibers are attached to the layer at a relative humidity of about 60%.

* * * * *